US008506156B2

(12) United States Patent
Tsubouchi et al.

(10) Patent No.: US 8,506,156 B2
(45) Date of Patent: Aug. 13, 2013

(54) DEVICE FOR DILUTING VISCOUS SUBSTANCE

(75) Inventors: Osamu Tsubouchi, Chiryu (JP); Fumio Takemura, Tsukuba (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 0 days.

(21) Appl. No.: 13/386,284

(22) PCT Filed: Jun. 28, 2010

(86) PCT No.: PCT/JP2010/004257

§ 371 (c)(1),
(2), (4) Date: Jan. 20, 2012

(87) PCT Pub. No.: WO2011/013296

PCT Pub. Date: Feb. 3, 2011

(65) Prior Publication Data

US 2012/0138276 A1 Jun. 7, 2012

(30) Foreign Application Priority Data

Jul. 30, 2009 (JP) ..... 2009-178068

(51) Int. Cl.
*B01F 7/16* (2006.01)

(52) U.S. Cl.
USPC ..... 366/147; 366/171.1; 366/181.4; 366/264

(58) Field of Classification Search
USPC ..... 366/147, 171.1, 181.4, 263–265
See application file for complete search history.

(56) References Cited

U.S. PATENT DOCUMENTS 612,317 A * 10/1898 Dundon ..... 366/263
1,309,219 A * 7/1919 Ruth ..... 209/169
1,911,644 A * 5/1933 Overbury ..... 366/172.1

(Continued)

FOREIGN PATENT DOCUMENTS

JP 4-14132 U 2/1992
JP 6-26725 A 2/1994

(Continued)

OTHER PUBLICATIONS

International Search Report (PCT/ISA/210) issued on Oct. 5, 2010, by Japanese Patent Office as the International Searching Authority for International Application No. PCT/JP2010/004257.

(Continued)

*Primary Examiner* — David Sorkin
(74) *Attorney, Agent, or Firm* — Buchanan Ingersoll & Rooney PC

(57) ABSTRACT

Provided is a device for diluting a viscous substance which is advantages in increasing frequency of contact between the viscous substance and a diluent in order to finely fragment the viscous substance, even when the viscous substance has a high viscosity, and efficiently dilute the viscous substance with the diluent. The device comprises a viscous substance supply portion 27 for supplying the viscous substance to the dilution chamber 20, a rotor 3 rotatably provided in the dilution chamber 20 and finely fragmenting the viscous substance supplied to the dilution chamber 20 by rotation to form a number of small fragments 92 of the viscous substance, and a diluent supply portion 28 for supplying a diluent such as water vapor to the dilution chamber 20 so that the diluent is contacted with the small fragments 92 formed by rotation of the rotor 3.

6 Claims, 5 Drawing Sheets

(56) References Cited

U.S. PATENT DOCUMENTS

| | | | | | |
|---|---|---|---|---|---|
| 2,190,896 | A | * | 2/1940 | Underwood | 366/265 |
| 2,522,947 | A | | 9/1950 | Hatch et al. | |
| 2,951,054 | A | * | 8/1960 | Hess | 523/305 |
| 3,400,915 | A | | 9/1968 | Onishi et al. | |
| 3,885,587 | A | * | 5/1975 | Troope | 137/391 |
| 3,951,386 | A | * | 4/1976 | Small et al. | 366/142 |
| 5,332,546 | A | | 7/1994 | Le Goff et al. | |

FOREIGN PATENT DOCUMENTS

| | | | |
|---|---|---|---|
| JP | 10-185356 | A | 7/1998 |
| JP | 2000-136328 | A | 5/2000 |
| JP | 2000-179989 | A | 6/2000 |
| JP | 2001-165528 | A | 6/2001 |
| JP | 2004-285139 | A | 10/2004 |
| WO | WO 2006/007681 | A1 | 1/2006 |

OTHER PUBLICATIONS

Written Opinion (PCT/ISA/237) issued on Oct. 5, 2010, by Japanese Patent Office as the International Searching Authority for International Application No. PCT/JP2010/004257.

Extended Search Report issued Apr. 25, 2012 by the European Patent Office, in the corresponding European Patent Application No. 10804049.4-1253. (7 pages).

* cited by examiner

DEVICE FOR DILUTING VISCOUS SUBSTANCE

TECHNICAL FIELD

The present invention relates to a viscous substance diluting device for diluting a viscous substance having a high viscosity with a diluent.

BACKGROUND ART

Background art will be described by taking an absorption heat pump device as an example. This device comprises a condenser for condensing water vapor to form liquid phase water, an evaporator for evaporating the liquid phase water formed in the condenser to form water vapor, an absorber for causing a highly viscous absorbing liquid to absorb the water vapor evaporated in the evaporator and diluting the absorbing liquid to form a diluted absorbing liquid, and a regenerator for concentrating the absorbing liquid by evaporating water contained in the diluted absorbing water formed in the absorber in the form of water vapor.

According to the abovementioned absorber, technique has been developed for causing the absorbing liquid to absorb the water vapor evaporated in the evaporator and diluting the absorbing liquid to form a diluted absorbing liquid. The absorbing liquid before absorbing the water vapor has a high viscosity and can be regarded as a tenacious material (a viscous substance). Therefore, the absorbing liquid before absorbing the water vapor tends to form a mass and hardly spreads, and therefore has a limit in absorbing the water vapor. Hence, dilution efficiency has not been sufficient.

Conventionally known as an example of the abovementioned absorber is an absorber in which a plurality of grooves are arranged in parallel on outer surfaces of heat transfer pipes in a longitudinal direction of the heat transfer pipes and fine concaves and convexes of oxide films are formed on the outer surfaces of the heat transfer pipes by applying oxidation treatment by heating the heat transfer pipes in the air (Patent Document 1). This document describes that this absorber improves in wettability at the outer surfaces of the heat transfer pipes, facilitates spreading of an absorbing liquid having a high viscosity along the outer surfaces of the heat transfer pipes and can enhance the absorbing ability that an absorbing liquid absorbs water vapor.

Moreover, known as an evaporator used in an absorption heat pump device is an evaporator with a system in which a dilute ammonia solution is atomized by a spray nozzle and introduced into heat transfer pipes (Patent Document 2). Furthermore, known as a liquid spray device of an absorption water cooler/heater is a device which causes a spray solution to flow out from tray holes of a bottom wall of a tray and drop down on heat transfer pipes of a heat exchanger (Patent Document 3).

Patent Document 1: Japanese Unexamined Patent Publication No. H10-185356

Patent Document 2: Japanese Unexamined Patent Publication No. 2001-165528

Patent Document 3: Japanese Unexamined Patent Publication No. 2000-179989

DISCLOSURE OF THE INVENTION

Problems to be Solved by the Invention

The present invention has been made to further improve the abovementioned prior art, and it is an object of the present invention to provide a device for diluting a viscous substance which is advantageous in efficiently diluting the viscous substance with a diluent by increasing frequency of contact between the viscous substance and the diluent even when the viscous substance has a high viscosity by finely fragmenting the viscous substance to form a small fragment group.

Means for Solving the Problems

A device for diluting a viscous substance according to the present invention comprises (i) a vessel having a dilution chamber; (ii) a viscous substance supply portion provided in the vessel and supplying the viscous substance to the dilution chamber; (iii) a rotor rotatably provided in the dilution chamber of the vessel and finely fragmenting the viscous substance supplied to the dilution chamber by rotation to form a small fragment group comprising a number of small fragments of the viscous substance; and (iv) a diluent supply portion provided in the vessel and supplying a diluent to the dilution chamber so that the small fragment group formed by rotation of the rotor and the diluent are contacted with each other.

The viscous substance supply portion supplies a viscous substance to the dilution chamber. The rotor rotates in the dilution chamber of the vessel, thereby finely fragmenting the viscous substance supplied to the dilution chamber by centrifugal force and forming a small fragment group comprising a number of small fragments of the viscous substance. Herein, because centrifugal force based on rotation of the rotor acts on the viscous substance, the size of the viscous substance is decreased based on centrifugal force, when compared to before centrifugal force acts on the viscous substance. The diluent supply portion supplies a diluent to the dilution chamber so that the small fragment group formed by rotation of the rotor and the diluent are contacted with each other. This increases frequency of contact between the viscous substance and the diluent. Therefore, the viscous substance is efficiently diluted with the diluent in the dilution chamber.

Advantageous Effects of Invention

According to the present invention, in diluting a viscous substance with a diluent, even when the viscous substance has a high viscosity, the viscous substance is finely fragmented by centrifugal force to form a small fragment group comprising a number of small fragments, and as a result surface area of the viscous substance increases. Hence, frequency of contact between the viscous substance and the diluent in the dilution chamber increases. Accordingly, the viscous substance is efficiently diluted with the diluent. Thus a dilute substance in which the viscous substance is diluted with the diluent is formed favorably.

BEST MODE FOR CARRYING OUT THE INVENTION

Figure 1:
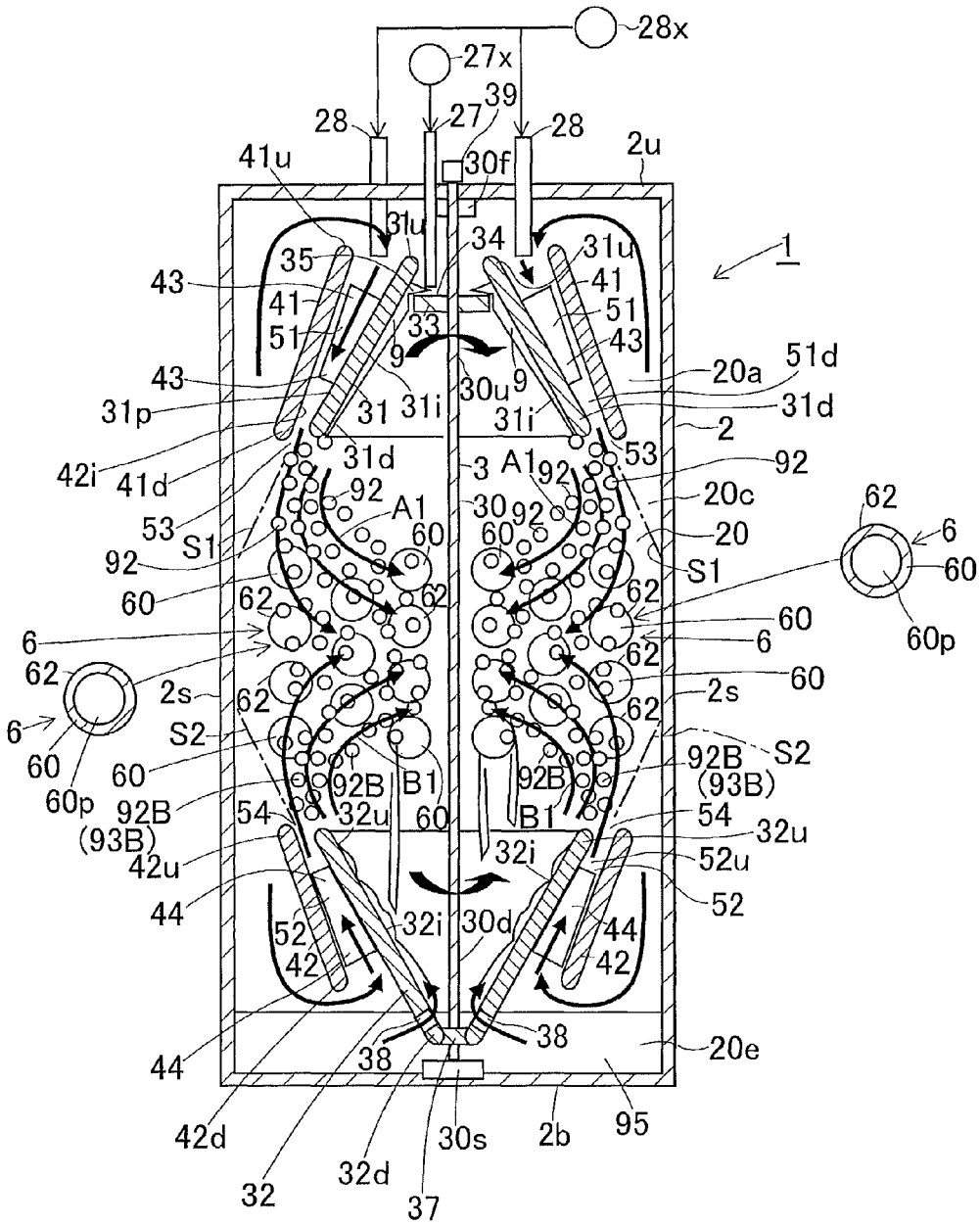
FIG. 1 is across sectional view showing an absorber according to a first embodiment.

According to one aspect of the present invention, a member for attachment to be attached by the small fragments of the viscous substance to be diluted with the diluent is provided in the dilution chamber of the vessel. Since the viscous substance has viscosity, the viscous substance attached to the member for attachment is suppressed from immediately dropping down. Therefore, time is secured for contact between the small fragments of the viscous substance and the diluent. Hence, time is secured for diluting the small fragments of the viscous substance with the diluent. The small fragments mean small pieces into which a viscous substance is mechanically crushed or scattered by centrifugal force of the rotor. The shape of the small fragments is not limited particularly. The size of the small fragments is not limited particularly. In view of increasing frequency of contact between the viscous substance and the diluent, generally the size is exemplified by not more than 10 mm, not more than 5 mm, not more than 3 mm, not more than 1 mm, and not more than 0.5 mm, but is not limited to these sizes. Herein, in general, as rotation speed of the rotor is higher, centrifugal force increases and the size of the small fragments tends to be smaller. As rotation speed of the rotor is lower, centrifugal force decreases and the size of the small fragments tends to be bigger.

The viscous substance mentioned here is a substance which is difficult to take a thin film form due to its own viscosity before diluted with a diluent. Even if sprayed by a spray nozzle, such a viscous substance hardly becomes small fragments and has a high possibility of clogging up the spray nozzle due to its high viscosity. It is preferable that such a viscous substance is finely fragmented by centrifugal force based on rotation of a rotor. The diluent can be anything as long as it can decrease viscosity of a viscous substance and can be exemplified by gas phase water, liquid phase water, gas phase-liquid phase-mixed water, and an organic solvent such as alcohol, but is not limited to these.

Although it depends on the kind, composition and the like of viscous substances, some viscous substances more easily absorb a diluent when cooled. In this case, it is preferable that the member for attachment has a cooling function to actively cool the small fragments attached to the member for attachment. Accordingly, it is preferable that the member for attachment comprises a heat transfer pipe group comprising a plurality of heat transfer pipes having a passage through which a refrigerant flows. The refrigerant can be any of gas phase, liquid phase and a mist form and can be, for example, a liquid coolant such as cooling water.

Some viscous substances more easily absorb a diluent when heated. In this case, the member for attachment can have a heating function to actively heat the small fragments attached to the member for attachment. Accordingly, it is preferable that the member for attachment is constituted by a heat transfer pipe group comprising a plurality of heat transfer pipes having a passage through which a heating medium flows. The heating medium can be any of gas phase, liquid phase and a mist form and can be, for example, heating liquid such as heating water.

According to another aspect of the present invention, it is preferable that the member for attachment comprises heat transfer pipes each having a passage through which a heat exchange medium flows. In this case, the heat exchange medium which flows through the passages of the heat transfer pipes exchanges heat with the viscous substance attached to the member for attachment. It is preferable that the heat exchange medium is a refrigerant. This is suitable to a case where a viscous substance more easily absorbs a diluent when cooled. In some cases, where a viscous substance more easily absorbs a diluent when the viscous substance has a high temperature, the heat exchange medium can be a warm medium such as warm water.

According to another aspect of the present invention, it is preferable that the vessel has a reservoir chamber for reserving the viscous substance diluted by the contact between the small fragment group of the viscous substance and the diluent. In this case, it is preferable that the device for diluting a viscous substance comprises a re-dilution rotary portion for dividing the viscous substance reserved in the reservoir chamber into small fragments again by rotation and bringing the small fragments and the diluent in contact with each other again so as to further dilute the viscous substance. The re-dilution rotary portion further increases frequency of contact between small fragments of the viscous substance and the diluent. Thus, the small fragments of the viscous substance are efficiently diluted with the diluent.

Furthermore, the re-dilution rotary portion can employ a system of being driven in association with the rotor by a common driving source with the rotor. In this case, since a common driving source is used, costs can be reduced. The re-dilution rotary portion can employ a system of being driven by another driving source. In this case, because the re-dilution rotary portion can be controlled independently of the rotor, the number of rotation of the re-dilution rotary portion and that of the rotor per unit time can be equal to or different from each other, so re-dilution of the viscous substance can be appropriately carried out.

According to another aspect of the present invention, it is preferable that the diluent supply portion supplies the diluent to an outer side of the small fragment group generated in the dilution chamber, thereby forming diluent flow and suppressing excessive scattering of the small fragment group by the diluent flow. This increases frequency of contact between the small fragments of the viscous substance and the diluent and allows the small fragments of the viscous substance to be efficiently diluted with the diluent. It is preferable that the diluent flow takes a curtain shape and covers the small fragment group from its outer side.

According to another aspect of the present invention, it is preferable that a diluent stirring portion for increasing probability of contact between the small fragments and the diluent by stirring the diluent in the dilution chamber is provided in the dilution chamber. Since this transfers the diluent in the diluent chamber, frequency of contact between the small fragments of the viscous substance and the diluent is increased and the viscous substance is efficiently diluted with the diluent.

According to another aspect of the present invention, it is preferable that the device is used in an absorber in an absorption heat pump device. Since performance of the absorber is enhanced, performance of the absorption heat pump device is enhanced. In this case, the viscous substance is an absorbing liquid. The absorbing liquid is exemplified by halogen compounds such as lithium bromide and lithium iodide, and alkali metal compounds. It is preferable that the diluent is gas phase or liquid phase water.

According to another aspect of the present invention, the device for diluting a viscous substance can employ a system of being mounted on a mobile object, or a stationary system of being fixed on a base or the like. Examples of the mobile object include vehicles (including passenger vehicles, trucks and trains), boats and ships, and flying objects.

First Embodiment

Hereinafter, a first embodiment of the present invention will be described with reference to FIG. 1. The present embodiment is applied to an absorber 1 in an absorption heat pump device (an absorption refrigerator). As shown in FIG. 1, the absorber 1 comprises a vessel 2 having a dilution chamber 20, an absorbing liquid supply portion 27 provided in the vessel 2 and serving as a viscous substance supply portion, a rotor 3 rotatably provided in the dilution chamber 20 of the vessel 2, and a water vapor supply portion 28 provided in the vessel 2 and serving as a diluent supply portion. The vessel 2 comprises an upper wall 2*u*, a bottom wall 2*b*, and a side wall 2*s*. The dilution chamber 20 comprises a machine chamber 20*a* on an upper side, a heat exchange chamber 20*c* provided under the machine chamber 20*a*, and a reservoir chamber 20*e* provided under the heat change chamber 20*c*.

The absorbing liquid supply portion 27 serving as a viscous substance supply portion is provided on the upper wall 2*u* of the vessel 2 and supplies a highly viscous absorbing liquid 9 (a viscous substance) downward from a supply source 27*x* toward the dilution chamber 20. The highly viscous absorbing liquid 9 is exemplified by lithium bromide and lithium iodide. The water vapor supply portion 28 serving as a diluent supply portion is provided on the upper wall 2*u* of the vessel 2 and supplies water vapor, which is gas phase water, downward from a water vapor source 28*x* (a diluent source) toward the dilution chamber 20.

The rotor 3 is rotatably provided in the dilution chamber 20 of the vessel 2 and comprises a vertical rotary shaft 30 to be rotated about an axis by a driving source 39, a first rotor 31 held on one end side 30*u* (an upper side) of the rotary shaft 30 and constituting a centrifugal first rotary atomizer, a second rotor 32 (a re-dilution rotary portion) held on the other end side 30*d* (a lower side) of the rotary shaft 30 and constituting a centrifugal second rotary atomizer. The rotary shaft 30 is rotatably supported by a first bearing 30*f* and a second bearing 30*s*. The first bearing 30*f* and the second bearing 30*s* suppress wobbling of the rotary shaft 30. The one end side 30*u* (the upper side) of the rotary shaft 30 is connected to the driving source 39 and rotated by the driving source 39. Preferably the driving source 39 is an electric motor driven by electric power or a fluid pressure motor driven by fluid pressure.

The first rotor 31 is held coaxially with the rotary shaft 30 on the one end side 30*u* (the upper side) of the rotary shaft 30 by way of a disk-shaped first connecting portion 33 or the like and has a conical shape whose inner diameter and outer diameter increase in a direction from an upper portion 31*u* to a lower portion 31*d*. The first connecting portion 33 faces the absorbing liquid supply portion 27 under the absorbing liquid supply portion 27, and has a receiving surface 34 for receiving the highly viscous absorbing liquid 9 supplied from the absorbing liquid supply portion 27. The receiving surface 34 is surrounded by the first rotor 31. The receiving surface 34 of the first connecting portion 33 is provided with a passage hole 35 for discharging the highly viscous absorbing liquid 9 toward an inner conical surface 31*i* of the first rotor 31.

Herein, when the first rotor 31 rotates around the rotary shaft 30, the first rotor 31 has a larger rotation radius at the lower portion 31*d* than a rotation radius at the upper portion 31*u* and accordingly centrifugal force of the lower portion 31*d* is greater than that of the upper portion 31*u*. Owing to the lower portion 31*d* of the first rotor 31 which thus generates a greater centrifugal force than the upper portion 31*u*, the highly viscous absorbing liquid 9 (the viscous substance) contacted with the inner conical surface 31*i* of the first rotor 31 can be finely fragmented and scattered outward by centrifugal force as fine particles 92. Therefore, fine particle formation (fine fragmentation) of the highly viscous absorbing liquid 9 can be promoted. As mentioned above, the first rotor 31 has a conical shape and centrifugal force of the lower portion 31*d* of the first rotor 31 can be increased when compared to centrifugal force of the upper portion 31*u*. Therefore, the first rotor 31 is advantageous in particle formation (fine fragmentation) of the highly viscous absorbing liquid 9 even when the absorbing liquid 9 has a high viscosity.

As shown in FIG. 1, the abovementioned second rotor 32 is arranged coaxially with the rotary shaft 30 on the other end side 30*d* (the lower side) of the rotary shaft 30 by way of a second connecting portion 37, and has a conical shape whose inner diameter and outer diameter increase in a direction from a lower portion 32*d* toward an upper portion 32*u*. The lower portion 32*d* of the second rotor 32 is immersed in the diluted absorbing liquid 95 (the viscous substance) reserved in the reservoir chamber 20*e*. A suction port 38 is provided for sucking up the diluted absorbing liquid 95 reserved in the reservoir chamber 20*e* when the second rotor 32 rotates, in a manner to penetrate the lower portion 32*d* of the second rotor 32 in a thickness direction thereof. Herein, the second rotor 32 has a larger rotation radius at the upper portion 32*u* than a rotation radius at the lower portion 32*d*. Therefore, when the second rotor 32 rotates around the rotary shaft 30, centrifugal force of the upper portion 32*u* is greater than that of the lower portion 32*d*. The highly viscous absorbing liquid 9 is sucked up by the upper portion 32*u* of the second rotor 32 which can thus generate a great centrifugal force. Since the highly viscous absorbing liquid 9 sucked up and contacted with an inner conical surface 32*i* of the second rotor 32 is thus finely fragmented and scattered outward by centrifugal force, fine particle formation can be promoted.

Thus the second rotor 32 has a conical shape whose diameter is greater at the upper portion 32*u* than at the lower portion 32*d* and centrifugal force of the lower portion 32*d* of the second rotor 32 can be increased, so it is advantageous in promoting formation of fine particles of the diluted absorbing liquid 95 (the viscous substance). As mentioned above, the first rotor 31 and the second rotor 32 have almost the same size and are opposed to each other. However, the first rotor 31 and the second rotor 32 are not limited to these.

As shown in FIG. 1, a first fixed body 41 is provided on an outer peripheral side of the first rotor 31 in the dilution chamber 20. The first fixed body 41 is provided approximately coaxially with the first rotor 31 and has a conical shape whose inner diameter and outer diameter increase in a direction from an upper portion 41*u* toward a lower portion 41*d*. A first passage 51 having a conical shape is formed between the first rotor 31 and the first fixed body 41. A second fixed body 42 is provided on an outer peripheral side of the second rotor 32 in the dilution chamber 20. The second fixed body 42 is provided approximately coaxially with the second rotor 32 and has a conical shape whose inner diameter and outer diameter increase in a direction from a lower portion 42*d* toward an upper portion 42*u*. A second passage 52 having a conical shape is formed between the second rotor 32 and the second fixed body 42. The first fixed body 41 and the second fixed body 42 are fixed in the dilution chamber 20 and do not rotate.

As shown in FIG. 1, projection-shaped first vanes 43 (a water vapor flow generating element) exhibiting a stirring function are formed on an outer conical surface 31*p* of the first rotor 31 as a diluent stirring portion. The first vanes 43 are arranged in the first passage 51 so as to face an inner conical surface 41*i* of the first fixed body 41. Projection-shaped second vanes 44 (a water vapor flow generating element) exhibiting a stirring function are formed on an outer conical surface 32*p* of the second rotor 32 as a diluent stirring portion. The second vanes 44 are provided in the second passage 52 so as to face an inner conical surface 42*i* of the second fixed body 42.

When water vapor as the diluent is supplied from the water vapor supply portion 28 to the dilution chamber 20, the water vapor flows downward while turned around by the first vanes 43 in the first passage 51, and is discharged downward from a first discharge port 53 at a fore end of the first passage 51, thereby forming water vapor flow (diluent flow). Water vapor as the diluent is also present on a side of the reservoir chamber 20*e*. Water vapor on the side of the reservoir chamber 20*e* flows upward while turned around by the second vanes 44 in the second passage 52, and is discharged upward from a second discharge port 54 at a fore end of the second passage 52, thereby forming water vapor flow (diluent flow).

According to the present embodiment, as shown in FIG. 1, the first passage 51 is designed to have a smaller passage width in a direction toward a lower end 51*d* (a fore end) thereof. Hence, flow rate of the water vapor flow discharged from the first discharge port 53 on the side of the lower end 51*d* of the first passage 51 can be increased and a water vapor curtain is easily formed. Similarly, the second passage 52 is designed to have a smaller passage width in a direction toward an upper end 52*u* (a fore end) thereof. Hence, flow rate of the water vapor flow discharged from the second discharge port 54 on the side of the upper end 52*u* of the second passage 52 is increased, and a water vapor curtain is easily formed.

As shown in FIG. 1, a heat transfer pipe group 6 as a cooling element is provided in the heat exchange chamber 20*c* of the dilution chamber 20 of the vessel 2 and serves as a member for attachment to be attached by the fine particles 92 of the highly viscous absorbing liquid 9. The heat transfer pipe group 6 comprises a plurality of heat transfer pipes 60. Since each of the heat transfer pipes 60 has a passage 60*p* to flow a refrigerant as a heat exchange medium, the heat transfer pipes 60 exhibit a cooling function to cool the highly viscous absorbing liquid 9 attached to the heat transfer pipes 60. In view of specific heat, it is preferable that the refrigerant to flow through the heat transfer pipes 60 is a liquid coolant such as cooling water. The heat transfer pipes 60 are constituted by pipes each having a passage 60*p* which is formed of a heat transfer material having a high heat transfer ability. The pipes are preferably formed of a metal having a high heat transfer ability, but in some cases can be formed of a hard resin or ceramic. In view of heat exchangeability of the heat transfer pipes 60, a metal having a high heat transfer ability is preferred. Examples of the metal include copper, copper alloys, aluminum, aluminum alloys, stainless steel and alloy steel. Since this highly viscous absorbing liquid 9 is disposed to generate heat and decrease in absorption rate upon absorbing water, it is effective to cool the highly viscous absorbing liquid 9.

When base material of the heat transfer pipes 60 is a metal, a corrosion-resistant film can be formed on an outer surface 62 of each of the heat transfer pipes 60, if necessary. It is also preferable to form a fine concave-convex structure on the outer surface 62 of each of the metal heat transfer pipes 60 in order to enhance wettability by water or the like. In some cases, where the absorbing liquid 9 is highly corrosive, a ceramic having a high heat transfer ability such as silicon carbide, beryllia, aluminum nitride and boron nitride can be employed as a base material of the heat transfer pipes 60. This is advantageous in securing a good corrosion resistance of the heat transfer pipes 60 and at the same time cooling the absorbing liquid 9, 95 attached to the heat transfer pipes 60.

In operation, the rotary shaft 30 of the rotor 3 is rotated about its axis by the driving source 39. This causes both the first rotor 31 and the second rotor 32 to rotate in the same direction in the dilution chamber 20. The receiving surface 34, the first vanes 43 and the second vanes 44 formed on the rotor 3 also rotate in the same direction. Rotation speed is appropriately selected depending on viscosity of the highly viscous absorbing liquid 9, desired centrifugal force and desired size of the fine particles 92.

Under this condition, the highly viscous absorbing liquid 9 having a high viscosity, which is a viscous substance, is supplied downward form the absorbing liquid supply portion 27 toward the receiving surface 34 of the rotor 3. The highly viscous absorbing liquid 9 having a high viscosity and received by the receiving surface 34 flows in an outward radial direction by centrifugal force which acts on the rotating receiving surface 34 and flows down due to gravity while contacted with the inner conical surface 31*i* of the first rotor 31. At this time, centrifugal force and gravity act on the highly viscous absorbing liquid 9 which is contacted with the inner conical surface 31*i* of the first rotor 31. Therefore, the highly viscous absorbing liquid 9 flows downward in a film shape while turned around about the rotary shaft 30 and contacted with the inner conical surface 31*i* of the first rotor 31. The film-shape highly viscous absorbing liquid 9 thus turned around along the inner conical surface 31*i* of the first rotor 31 is finely fragmented and scattered by centrifugal force as a fine particle group (a small fragment group) comprising a number of fine particles 92 approximately in a tangential direction. Thus the fine particle group comprising a number of fine particles 92 of the highly viscous absorbing liquid 9 is formed by centrifugal force based on rotation of the first rotor 31.

In operation, water vapor, which is gas phase water, is supplied downward from the water vapor supply portion 28 into the dilution chamber 20 as a diluent. Water vapor flows through the first passage 51 between the first rotor 31 and the first fixed body 41 while turned around by the first vanes 43. Furthermore, water vapor is discharged downward from the first discharge port 53 at the fore end of the first passage 51 as water vapor flow while turned around. Thus the water vapor flow is discharged outward by centrifugal force of the first rotor 31.

Herein, as can be understood from FIG. 1, the highly viscous absorbing liquid 9 flows along the inner conical surface 31*i* of the first rotor 31 and water vapor flows along the first passage 51 on the outer peripheral side of the first rotor 31. Therefore, the water vapor flow (diluent flow) discharged from the first discharge port 53 is located on an outer side of the fine particle group 93 of the fine particles 92 of the highly viscous absorbing liquid 9 scattered from the first rotor 31. As a result, the fine particle group 93 (the small fragment group) of the fine particles 92 of the highly viscous absorbing liquid 9 is suppressed from scattering excessively outward. Therefore, the fine particle group 93 of the fine particles 92 of the highly viscous absorbing liquid 9 formed by the first rotor 31 have a high existence probability at the heat transfer pipe group 6 located just under the first rotor 31, so the fine particles 92 easily get attached to the outer surfaces 62 of the heat transfer pipes 60.

When the fine particles 92 of the highly viscous absorbing liquid 9 are thus attached to the outer surfaces 62 of the heat transfer pipes 60, time spent in the dilution chamber 20 increases and time is secured for absorbing water vapor in the dilution chamber 20, so the highly viscous absorbing liquid 9 is effectively diluted. Upon absorbing water vapor, the highly viscous absorbing liquid 9 decreases in viscosity. Therefore, the diluted absorbing liquid 9 decreases in viscosity and drops down from the outer surfaces 62 of the heat transfer pipes 60 onto lower ones of the heat transfer pipes 60 or into the reservoir chamber 20*e*. The absorbing liquid 9 which has dropped and gotten attached to the lower heat transfer pipes 60 is securely given time for contact with water vapor again and decreases in viscosity, and then flows down. According to the present embodiment, because the heat transfer pipes 60 are provided in a plurality of steps in a height direction, as the absorbing liquid 9 absorbs water vapor and decreases in viscosity, the absorbing liquid 9 attached to upper ones of the heat transfer pipes 60 thus gradually gets attached to lower ones of the heat transfer pipes 60 and eventually gets reserved in the reservoir chamber 20*e* as the diluted absorbing liquid 95.

Herein, since the outer surfaces 62 of the heat transfer pipes 60 have a circular outer contour in cross section, the absorbing liquid 9 once diluted easily drops down along the outer surfaces 62 by gravity. On the other hand, the fine particles 92 of the highly viscous absorbing liquid 9 which have not gotten attached to the heat transfer pipes 60 also absorb water vapor and get diluted in the dilution chamber 20, drop down toward the reservoir chamber 20*e* and get reserved as the diluted absorbing liquid 95 in the reservoir chamber 20*e*.

When the diluted absorbing liquid 95 reserved in the reservoir chamber 20*e* increases, the suction port 38 of the second rotor 32 is immersed in the diluted absorbing liquid 95 in the reservoir chamber 20*e*. When under this condition the second rotor 32 is also rotated about the axis of the rotary shaft 30 in the same direction by rotation of the rotor 3, the diluted absorbing liquid 95 reserved in the reservoir chamber 20*e* is sucked up from the suction port 38 of the second rotor 32 along the inner conical surface 32*i* of the second rotor 32 by centrifugal force of the second rotor 32. The diluted absorbing liquid 95 thus sucked up along the inner conical surface 32*i* of the second rotor 32 is transferred upward, while turned around, along the inner conical surface 32*i* of the second rotor 32 by centrifugal force based on rotation of the second rotor 32. Furthermore, the diluted absorbing liquid 95 rotated along the inner conical surface 32*i* of the second rotor 32 is scattered by centrifugal force based on rotation of the second rotor 32 as a fine particle group 93B (a small fragment group) comprising a number of fine particles 92B (small fragments). The fine particles 92B of the diluted absorbing liquid 95 are thus formed in the dilution chamber 20 by centrifugal force of the second rotor 32.

The fine particle group 93B of the fine particles 92B of the diluted absorbing liquid 95 thus formed by the second rotor 32 head for the heat transfer pipe group 6 and get attached to the outer surfaces 62 of the heat transfer pipes 60. The diluted absorbing liquid 95 attached to the heat transfer pipes 60 as the fine particles 92B is securely given time to be spent in the dilution chamber 20 and absorbs water vapor in the dilution chamber 20 and gets diluted again and further decreases in viscosity. Upon decreasing in viscosity, the diluted absorbing liquid 95 on the heat transfer pipes 60 drops down from the heat transfer pipes 60 toward the reservoir chamber 20*e* by gravity and gets reserved in the reservoir chamber 20*e* again. On the other hand, the fine particles 92B which have not gotten attached to the heat transfer pipes 60 also absorb water vapor and get diluted, and then drop down and get reserved in the reservoir chamber 20*e* as the diluted absorbing liquid 95. The diluted absorbing liquid 95 thus once diluted is sucked up and divided into fine particles again by rotation of the second rotor 32 and is contacted with water vapor again. Therefore, dilution performance of the device according to the present embodiment can be further improved.

Water vapor is also present in the vicinity of the reservoir chamber 20*e*. Therefore, with rotation of the second rotor 32, water vapor, which is gas phase water, is supplied upward, while turned around, by the second vanes 44. This water vapor is discharged upward, while turned around, from the second discharge port 54 at the fore end of the second passage 52 between the second rotor 32 and the second fixed body 42, thereby forming water vapor flow. The water vapor flow is discharged in an upper outward direction by centrifugal force of the second rotor 32.

At this time, the water vapor flow generated by rotation of the first rotor 31, which is located above the second rotor 32, is discharged from the first discharge port 53 of the first passage 51. Therefore, both the water vapor flow discharged from the first discharge port 53 and the water vapor flow discharged from the second discharge port 54 collide against and interfere with each other. As a result of such a collision and interference, the water vapor flow discharged from the first discharge port 53 flows in the direction of an arrow A1 (see FIG. 1) and heads for the heat transfer pipe group 6. The water vapor flow discharged from the second discharge port 54 flows in the direction of an arrow B1 (see FIG. 1) and heads for the heat transfer pipe group 6. The fine particles 92, 92B surrounded and restricted by these water vapor flows are also liable to flow in these directions. That is to say, the fine particles 92 formed by the first rotor 31 flow in the direction of the arrow A1 and head for the heat transfer pipe group 6 and are liable to get attached to the heat transfer pipe group 6. The fine particles 92 formed by the second rotor 32 flow in the direction of the arrow B1 and head for the heat transfer pipe group 6 and are liable to get attached to the heat transfer pipe group 6. Therefore, the phenomenon of attaching to the heat transfer pipe group 6 can be effectively used in causing the fine particles 92 to absorb water vapor.

Particularly according to the present embodiment, as can be understood from FIG. 1, the side wall 2*s* of the vessel 2 is arranged so as to cross first extension line S1 of the first passage 51 and second extension line S2 of the second passage 52. Herein, the side wall 2*s* serves as an obstacle against the water vapor flow discharged from the first discharge port 53 and the water vapor flow discharged from the second discharge port 54. As a result of this, upon colliding against the side wall 2*s*, the water vapor flow discharged from the first discharge port 53 and the water vapor flow discharged from the second discharge port 54 reflect in directions away from the side wall 2*s* and make it easy to guide the fine particles 92, 92B in the directions of the arrows A1, B1 toward the heat transfer pipe group 6.

As mentioned above, according to the present embodiment, since the fine particles 92 of the highly viscous absorbing liquid 9 formed by the first rotor 31 of the rotor 3 and water vapor are contacted with each other, area and frequency of contact between the fine particles 92 of the highly viscous absorbing liquid having a high viscosity and water vapor increase. This allows the highly viscous absorbing liquid 9 to absorb water vapor efficiently. Particularly the highly viscous absorbing liquid 9 used in the present embodiment increases in temperature due to reaction heat upon absorbing water, so the highly viscous absorbing liquid 9 more easily absorb water vapor when cooled. In this respect, according to the present embodiment, since the highly viscous absorbing liquid 9 attached to the outer surfaces 62 of the heat transfer pipes 60 constituting the heat transfer pipe group 6 is made to absorb water vapor while positively cooled by the refrigerant which flows through the passages 60*p* of the heat transfer pipes 60, the highly viscous absorbing liquid 9 can absorb water vapor efficiently.

Furthermore, according to the present embodiment, the diluted absorbing liquid 95 which has absorbed water vapor is sucked up by the second rotor 32 to form the fine particles 92B of the diluted absorbing liquid 95 (the viscous substance) again, and these fine particles 92B are attached to the heat transfer pipe group 6 and allowed to absorb water vapor while cooled by the heat transfer pipe group 6. Therefore, the diluted absorbing liquid 95 can further absorb water vapor.

As mentioned above, according to the present embodiment, the fine particles 92, 92B of the absorbing liquid 9, 95 are securely given time for attachment to the outer surfaces 62 of the heat transfer pipes 60. Accordingly, when compared to a case where the fine particles 92 immediately drop down without getting attached to the heat transfer pipes 60, time is secured for contact between the absorbing liquid 9, 95 attached to the outer surfaces 62 of the heat transfer pipes 60 and water vapor and it is advantageous in increasing the amount of water vapor absorbed. Herein, since water vapor in the dilution chamber 20 is stirred by the first vanes 43 of the first rotor 31 and the second vanes 44 of the second rotor 32, water vapor circulates without being accumulated in the dilution chamber 20. In this meaning too, it is advantageous in increasing frequency of contact between the absorbing liquid 9, 95 and water vapor.

Furthermore, according to the present embodiment, as can be understood from FIG. 1, the size and shape of the first rotor 31 and the second rotor 32 are almost the same as each other. Furthermore, the first rotor 31 and the second rotor 32 are located so as to face each other. Therefore, when the rotor 3 having the first rotor 31 and the second rotor 32 rotates around the rotary shaft 30, centrifugal force generated by the first rotor 31 and centrifugal force generated by the second rotor 32 can be as close to each other as possible, and rotational balance of the rotor 3 can be adjusted, which contributes to a reduction in vibration. This is suitable to a case where the rotor 3 is rotated at high speed in order to obtain great centrifugal force with an aim to make the size of the fine particles 92, 92B very small. Moreover, the size and shape of the first fixed body 41 and the second fixed body 42 are almost the same as each other. This can contribute to common use of component parts. It should be noted that once operation of diluting the highly viscous absorbing liquid 9 with water vapor is finished, the diluted absorbing liquid 95 in the reservoir chamber 20*e* can be removed from the reservoir chamber 20*e* by opening a valve (not shown).

Second Embodiment

Figure 2:
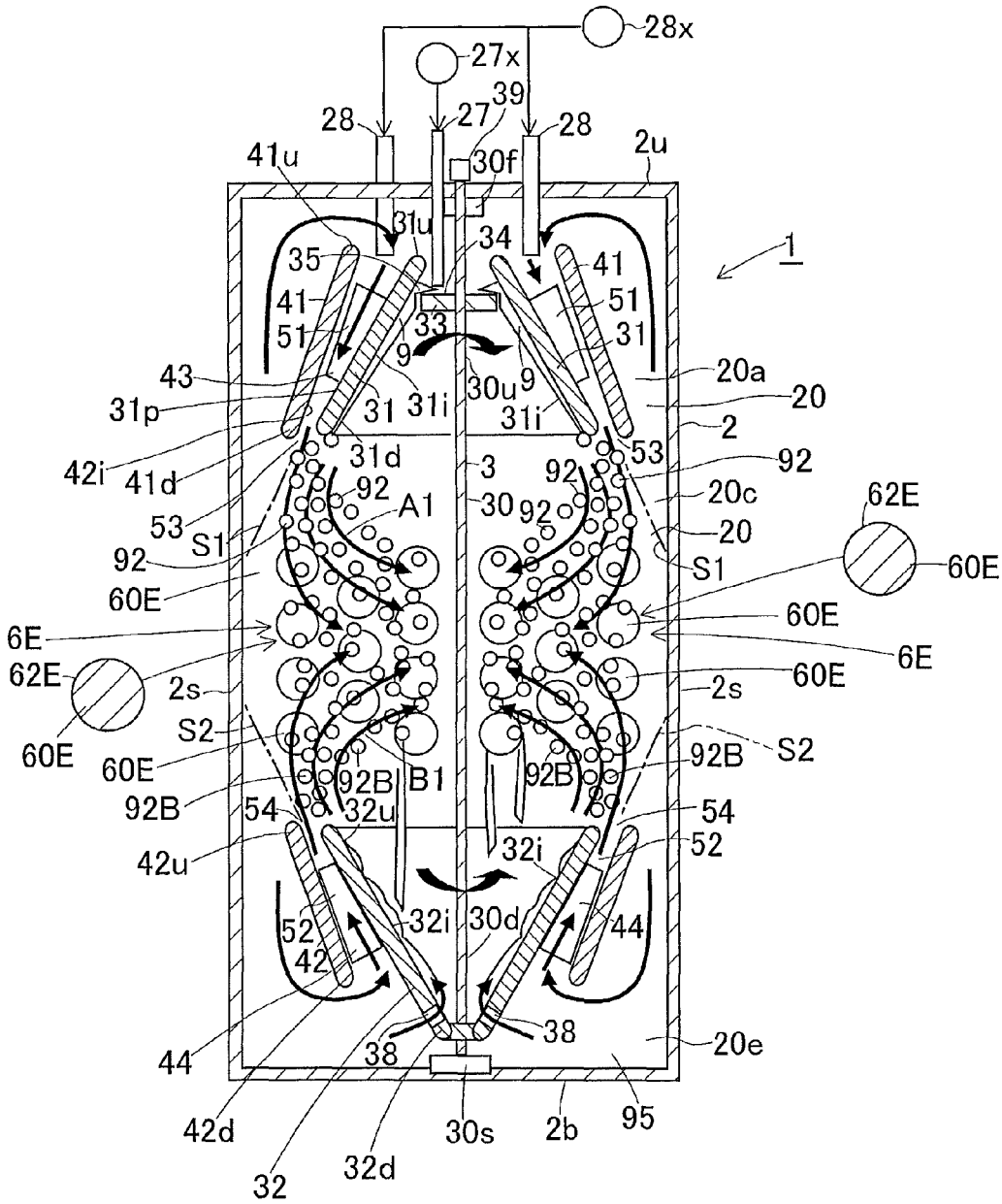
FIG. 2 is across sectional view showing an absorber according to a second embodiment.

FIG. 2 shows a second embodiment. The present embodiment has basically similar constitution and effects to those of the first embodiment. However, a member for attachment 6E comprising a plurality of bars 60E having a circular cross section is provided instead of the heat transfer pipes 60. The member for attachment 6E does not have a function to flow a refrigerant. The bars 60E may have a rectangular or triangular cross section.

The fine particle group 93 of the fine particles 92 formed by the first rotor 31 head for the member for attachment 6E and get attached to outer surfaces 62E of the bars 60E. The fine particles 92 of the highly viscous absorbing liquid 9 attached to the member for attachment 6E are contacted with and absorb water vapor in the dilution chamber 20 and get diluted. Upon absorbing water vapor, the highly viscous absorbing liquid 9 having viscosity decreases in viscosity, and accordingly drops down from the outer surfaces 62E of the bars 60E toward the reservoir chamber 20*e* by gravity and gets reserved in the reservoir chamber 20*e* as the diluted absorbing liquid 95. The fine particles 92 which have not gotten attached to the member for attachment 6E also absorb water vapor and get diluted and then drop down toward the reservoir chamber 20*e* and get reserved in the reserved chamber 20*e* as the diluted absorbing liquid 95.

Since the fine particles 92 are thus attached to the outer surfaces 62E of the bars 60E, time to be spent in the dilution chamber 20 is secured. Accordingly, when compared to a case where the fine particles 92 immediately drop down without getting attached to the outer surfaces 62E of the bars 60E, time is secured for contact between the absorbing liquid 9, 95 attached to the outer surfaces 62E of the bars 60E and water vapor and it is advantageous in increasing the amount of water vapor absorbed.

Also in the present embodiment, since water vapor in the dilution chamber 20 is stirred by the first vanes 43 of the first rotor 31 and the second vanes 44 of the second rotor 32, water vapor is stirred in the dilution chamber 20. In this meaning, too, it is advantageous in increasing frequency of contact between the fine particles 92 of the highly viscous absorbing liquid 9 and water vapor and frequency of contact between the fine particles 92 of the diluted absorbing liquid 95 and water vapor, and it is advantageous in increasing the amount of water vapor absorbed.

Third Embodiment

Figure 3:
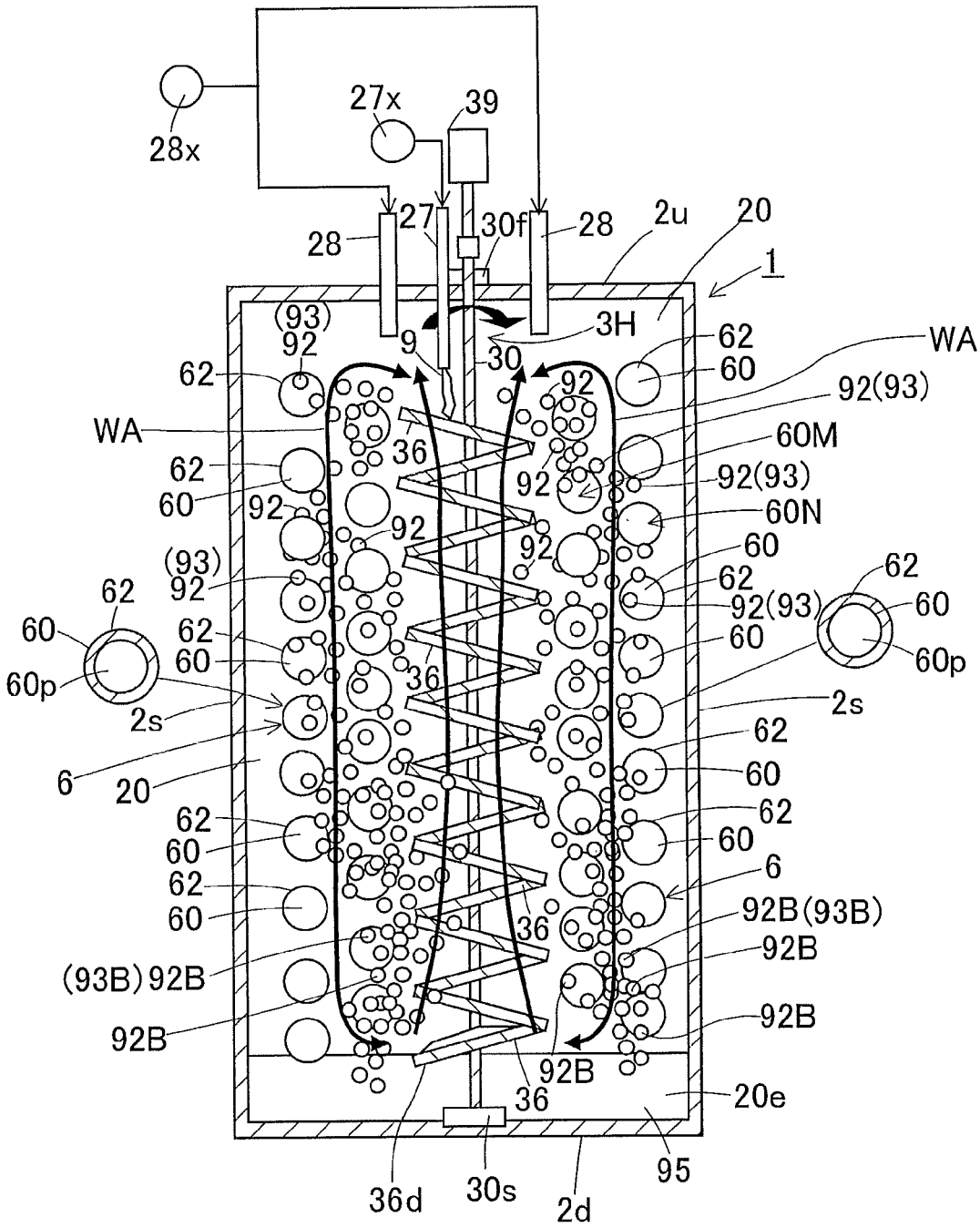
FIG. 3 is across sectional view showing an absorber according to a third embodiment.

FIG. 3 shows a third embodiment. The present embodiment has basically similar constitution and effects to those of the first embodiment. An absorber 1 comprises a vessel 2 having a dilution chamber 20, an absorbing liquid supply portion 27 provided in the vessel 2 and serving as a viscous substance supply portion, a rotor 3H rotatably provided in the dilution chamber 20 of the vessel 2 and constituting a rotary atomizer, and a water vapor supply portion 28 provided in the vessel 2 and serving as a diluent supply portion. The vessel 2 comprises an upper wall 2*u*, a bottom wall 2*b*, and a side wall 2*s*. The dilution chamber 20 has a reservoir chamber 20*e* on a lower side thereof.

The absorbing liquid supply portion 27 is provided on the upper wall 2*u* of the vessel 2 and supplies a highly viscous absorbing liquid 9 (a viscous substance) fed from a supply source 27*x* downward to the dilution chamber 20. The water vapor supply portion 28 is provided on the upper wall 2*u* of the vessel 2 and supplies water vapor, which is gas phase water, downward from a water vapor source 28*x* (a diluent source) to the dilution chamber 20.

The rotor 3H is rotatably provided in the dilution chamber 20 of the vessel 2 and comprises a vertical rotary shaft 30 to be rotated about an axis by a driving source 39 such as a driving motor, and a spiral blade 36 spirally wound around an outer circumferential surface of the rotary shaft 30. A lower end portion 36*d* of the spiral blade 36 is immersed in a diluted absorbing Liquid 95 reserved in the reservoir chamber 20*e*, and can serve as a fine particle re-forming element which sucks up the diluted absorbing liquid 95 reserved in the reservoir chamber 20*e* and dividing the liquid into fine particles again. The rotary shaft 30 is rotatably supported by a first bearing 30*f* and a second bearing 30*s*. The first bearing 30*f* and the second bearing 30*s* suppress wobbling of the rotary shaft 30.

When the rotary shaft 30 of the rotor 3H is rotated about its axis by the driving source 39, the spiral blade 36 rotates in a direction to suck up the diluted absorbing liquid 95 reserved in the reservoir chamber 20*e*, thereby forming a fine particle group 93B of fine particles 92B of the diluted absorbing liquid 95.

As shown in FIG. 3, a heat transfer pipe group 6 serving as a member for attachment to be attached by the fine particles 92 of the highly viscous absorbing liquid 9 is provided in the dilution chamber 20 of the vessel 2. The heat transfer pipe group 6 is arranged on an outer peripheral side of the spiral blade 36 and provided with a plurality of heat transfer pipes 60. The heat transfer pipes 60 exhibit a cooling function because each of the heat transfer pipes 60 has a passage 60*p* to flow a refrigerant. In view of cooling performance, it is preferable that the refrigerant is a liquid coolant such as cooling water. Herein, the heat transfer pipe group 6 comprises an inner heat transfer pipe 60M in the form of an inner coil arranged approximately coaxially with the rotary shaft 30 on an outer side of the rotary shaft 30, and an outer heat transfer pipe 60N in the form of an outer coil arranged approximately coaxially with the rotary shaft 30 on the outer side of the rotary shaft 30. The outer heat transfer pipe 60N is arranged coaxially on the outer peripheral side than the inner heat transfer pipe 60M. However, a number of heat transfer pipes 60 can be arranged in a horizontal direction.

In operation, the rotary shaft 30 of the rotor 3 is rotated about its axis by the driving source 39. This causes the spiral blade 36 to rotate around the rotary shaft 30 in the dilution chamber 20. Under this condition, the highly viscous absorbing liquid 9 having a highly viscosity, which is a viscous substance, is supplied downward from the absorbing liquid supply portion 27 toward the spiral blade 36 in the dilution chamber 20. This causes the highly viscous absorbing liquid 9 to collide against the spiral blade 36 rotating at a high speed. As a result, the highly viscous absorbing liquid 9 is finely fragmented and scattered by centrifugal force as the fine particle group 93 (the small fragment group) comprising a number of fine particles 92 (small fragments). The fine particle group 93 comprising a number of fine particles 92 of the highly viscous absorbing liquid 9 is thus formed by the spiral blade 36. These fine particles 92 are scattered in the dilution chamber 20 and get attached to the outer surfaces 62 of the heat transfer pipes 60 in the dilution chamber 20. The fine particles 92 of the highly viscous absorbing liquid 9 attached to the heat transfer pipes 60 are securely given time to be spent in the dilution chamber 20 and absorb water vapor in the dilution chamber 20, thereby effectively diluted. Upon absorbing water vapor, the absorbing liquid 9 decreases in viscosity. Therefore, the diluted absorbing liquid 95 drops down from the outer surfaces 62 of the heat transfer pipes 60 to lower ones of the heat transfer pipes 60 by gravity.

Thus, the absorbing liquid 9 which has absorbed water vapor and gotten diluted decreases in viscosity and drops down from the outer surfaces 62 of the heat transfer pipes 60 onto lower ones of the heat transfer pipes 60 or into the reservoir chamber 20*e*. The absorbing liquid 9 which has dropped down and gotten attached onto the lower heat transfer pipes 60 is securely given time for contact with water vapor again, further decreases in viscosity and then flows down. As described above, according to the present embodiment, as shown in FIG. 3, because the heat transfer pipes 60 are provided in a plurality of steps in a height direction, as the absorbing liquid 9 attached to upper ones of the heat transfer pipes 60 absorbs more water vapor and decreases in viscosity, this absorbing liquid 9 gradually gets attached to lower ones of the heat transfer pipes 60 and eventually gets reserved in the reservoir chamber 20*e* as the diluted absorbing liquid 95.

Herein, according to the present embodiment, since the outer surfaces 62 of the heat transfer pipes 60 have a circular cross section, the highly viscous absorbing liquid 9 attached to the heat transfer pipes 60 automatically drops down upon decreasing in viscosity. On the other hand, the fine particles 92 of the viscous substance which have not gotten attached to the outer surfaces 62 of the heat transfer pipes 60 also absorb water vapor in the dilution chamber 20 and get diluted, drop down toward the reservoir chamber 20*e* as the diluted absorbing liquid 95, and get reserved in the reservoir chamber 20*e*. Since the fine particles 92 are securely given time for attachment to the outer surfaces 62 of the heat transfer pipes 60, when compared to a case where the fine particles 92 immediately drop down, time is secured for contact between the absorbing liquid 9 attached to the outer surfaces 62 of the heat transfer pipes 60 and water vapor and it is advantageous in increasing the amount of water vapor absorbed.

As mentioned above, since the spiral blade 36 rotates around the rotary shaft 30, the spiral blade 36 sucks up the diluted absorbing liquid 95 reserved in the reservoir chamber 20*e* and forms the fine particle group 93 of the fine particles 92B of the diluted absorbing liquid 95. In this case, the fine particles 92B of the diluted absorbing liquid 95 formed by the spiral blade 36 head for the heat transfer pipe group 6 and get attached to the outer surfaces 62 of the heat transfer pipes 60. The fine particles 92B of the diluted absorbing liquid 95 attached to the heat transfer pipes 60 absorb water vapor and get diluted again. The diluted absorbing liquid 95 drops down from the heat transfer pipes 60 toward the reservoir chamber 20*e* by gravity, and gets reserved in the reservoir chamber 20*e* again. On the other hand, the fine particles 92B of the diluted absorbing liquid 95 which have not gotten attached to the heat transfer pipes 60 also absorb water vapor and get diluted and then drop down toward the reservoir chamber 20*e* as the diluted absorbing liquid 95, and get reserved in the reservoir chamber 20*e* as the diluted absorbing liquid 95. Since the diluted absorbing liquid 95 once diluted is thus sucked up and divided into fine particles again by rotation of the spiral blade 36 of the rotor 3 and is contacted with water vapor, dilution performance of the device of the present embodiment can be further improved.

Herein, when the spiral blade 36 rotates around the rotary shaft 30, pushing force can be exhibited so as to push upward a substance (e.g., water vapor) which is contacted with the spiral blade 36 in correspondence to a helical angle of the spiral blade 36. Therefore, when the spiral blade 36 rotates in the dilution chamber 20, water vapor on the spiral blade 36 transfers upward in the dilution chamber 20 in correspondence to the helical angle of the spiral blade 36, and moreover, the water vapor which has transferred upward is restricted by the upper wall 2*u* of the vessel 1 and then transfers downward. Thus formed is water vapor circulating flow WA in which water vapor transfers in the dilution chamber 20. Therefore, the spiral blade 36 can also serve as a water vapor circulating flow generating element for forming water vapor circulating flow WA, and in addition, as an element for generating the fine particle group 93 comprising a number of fine particles 92 of the absorbing liquid 9 and the fine particle group 93B comprising a number of fine particles 92B of the diluted absorbing liquid 95. This is advantageous in increasing frequency of contact between the fine particles 92 of the highly viscous absorbing liquid 9 and water vapor and frequency of contact between the fine particles 92B of the diluted absorbing liquid 95 and water vapor, and increasing the amount of water vapor absorbed to dilute the absorbing liquid 9, 95.

As mentioned above, according to the present embodiment, since the fine particle group 93 of the fine particles 92 of the highly viscous absorbing liquid 9 formed by rotation of the spiral blade 36 of the rotor 3 and water vapor are contacted with each other as shown in FIG. 3, area and frequency of contact between the highly viscous absorbing liquid 9 having a high viscosity and water vapor increase. Therefore, even when the highly viscous absorbing liquid 9 supplied from the absorbing liquid supply portion 27 has a high viscosity, this highly viscous absorbing liquid 9 can efficiently absorb water vapor and get diluted.

Since particularly the highly viscous absorbing liquid 9 used in the present embodiment increases in temperature due to reaction heat upon absorbing water, the highly viscous absorbing liquid 9 more easily absorbs water vapor when cooled. In this respect, according to the present embodiment, since the highly viscous absorbing liquid 9 attached to the outer surfaces 62 of the heat transfer pipes 60 constituting the heat transfer pipe group 6 is made to absorb water vapor while being cooled by a refrigerant which flows through the passages 60*p* of the heat transfer pipes 60, the highly viscous absorbing liquid 9 can efficiently absorb water vapor.

Furthermore, according to the present embodiment, the diluted absorbing liquid 95 in the reservoir chamber 20*e* which has once absorbed water vapor is sucked up based on rotation of the spiral blade 36 to form the fine particles 92B of the diluted absorbing liquid 95 again, and the fined particles 92B of the diluted absorbing liquid 95 are attached to the heat transfer pipe group 6 and allowed to absorb water vapor, while being cooled by the heat transfer pipe group 6. Therefore, such a merit can be obtained that the highly viscous absorbing liquid 9 can further absorb water vapor. Although one spiral blade 36 is employed in the present embodiment as shown in FIG. 3, the number is not limited to one and a plurality of spiral blades 36 can be arranged in parallel to each other. In this case, it is preferable that the plurality of spiral blades 36 are rotated in the same direction.

Fourth Embodiment

Figure 4:
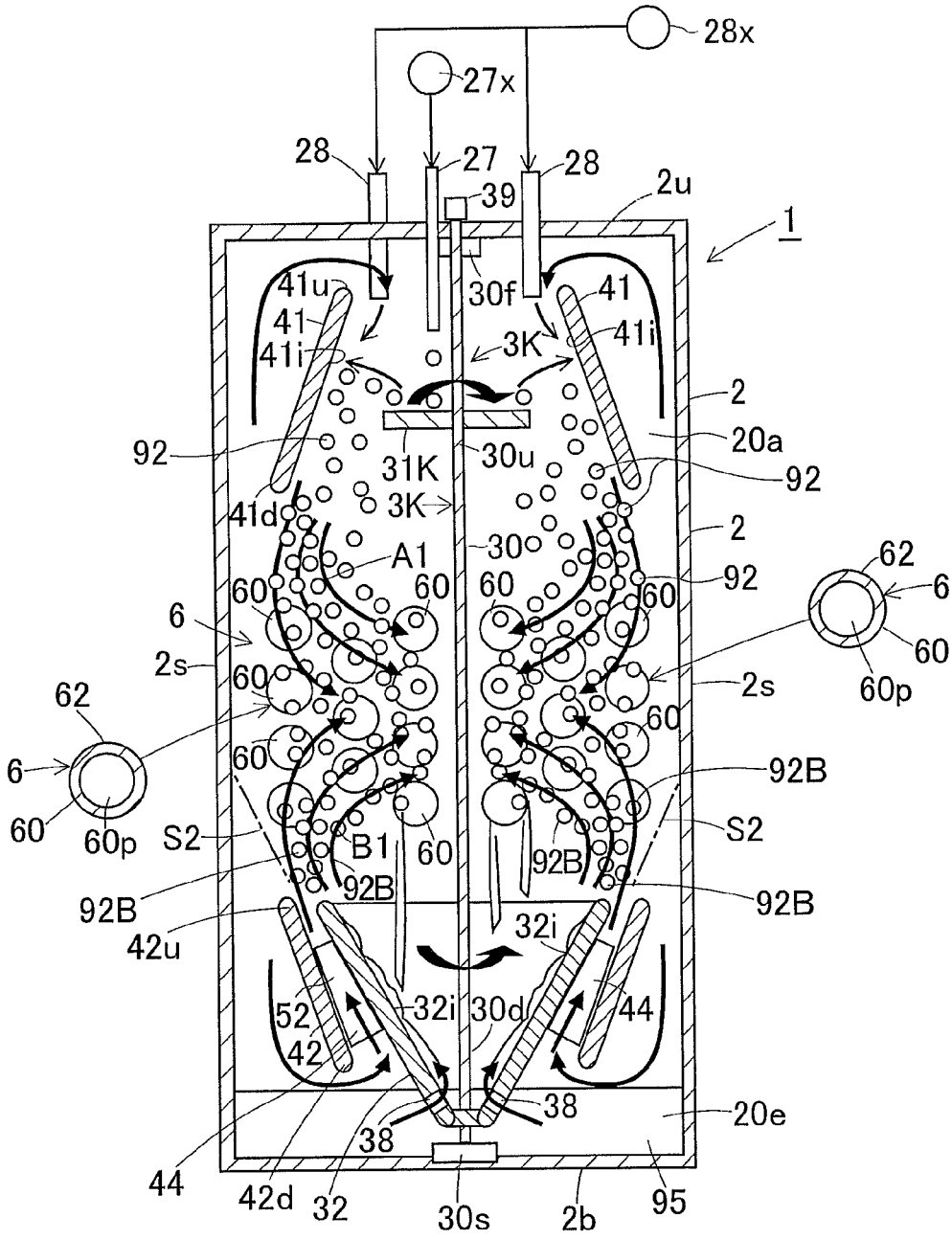
FIG. 4 is across sectional view showing an absorber according to a fourth embodiment.

FIG. 4 shows a fourth embodiment. The present embodiment has basically similar constitution and effects to those of the first embodiment. The following description will focus on differences. As shown in FIG. 4, a rotor 3K is rotatably provided in a dilution chamber 20 of a vessel 2 and comprises a vertical rotary shaft 30 to be rotated about an axis of the rotary shaft 30 by a driving source 39, a disk-shaped first rotor 31K held on one end side 30*u* (an upper side) of the rotary shaft 30 and constituting a centrifugal first rotary atomizer, and a second rotor 32 (a re-dilution rotary portion) held on the other end side 30*d* (a lower side) of the rotary shaft 30 and constituting a centrifugal second rotary atomizer.

When the rotor 3K rotates around the rotary shaft 30, the disk-shaped first rotor 31 rotates in the same direction. Then, when an absorbing liquid 9 is dropped down from an absorbing liquid supply portion 27, the dropped absorbing liquid 9 collides against the disk-shaped first rotor 31K and divided into a plurality of fine particles 92 by centrifugal force. Herein, since the disk-shaped first rotor 31K is surrounded by a first fixed body 41, the fine particles 92 generated by centrifugal force based on rotation of the first rotor 31K collide against an inner conical surface 41*i* of the conical first fixed body 41. Therefore, the fine particles 92 are suppressed from scattering excessively. Accordingly, the fine particles 92 are guided toward heat transfer pipes 6 by the inner conical surface 41*i* of the first fixed body 41 and get attached to heat transfer pipes 60 of a heat transfer pipe group 6. Since water vapor is blown downward from a water vapor supply portion 28, absorbing liquid 9, 95 attached to the heat transfer pipes 60 is diluted with the water vapor.

Fifth Embodiment

Figure 5:
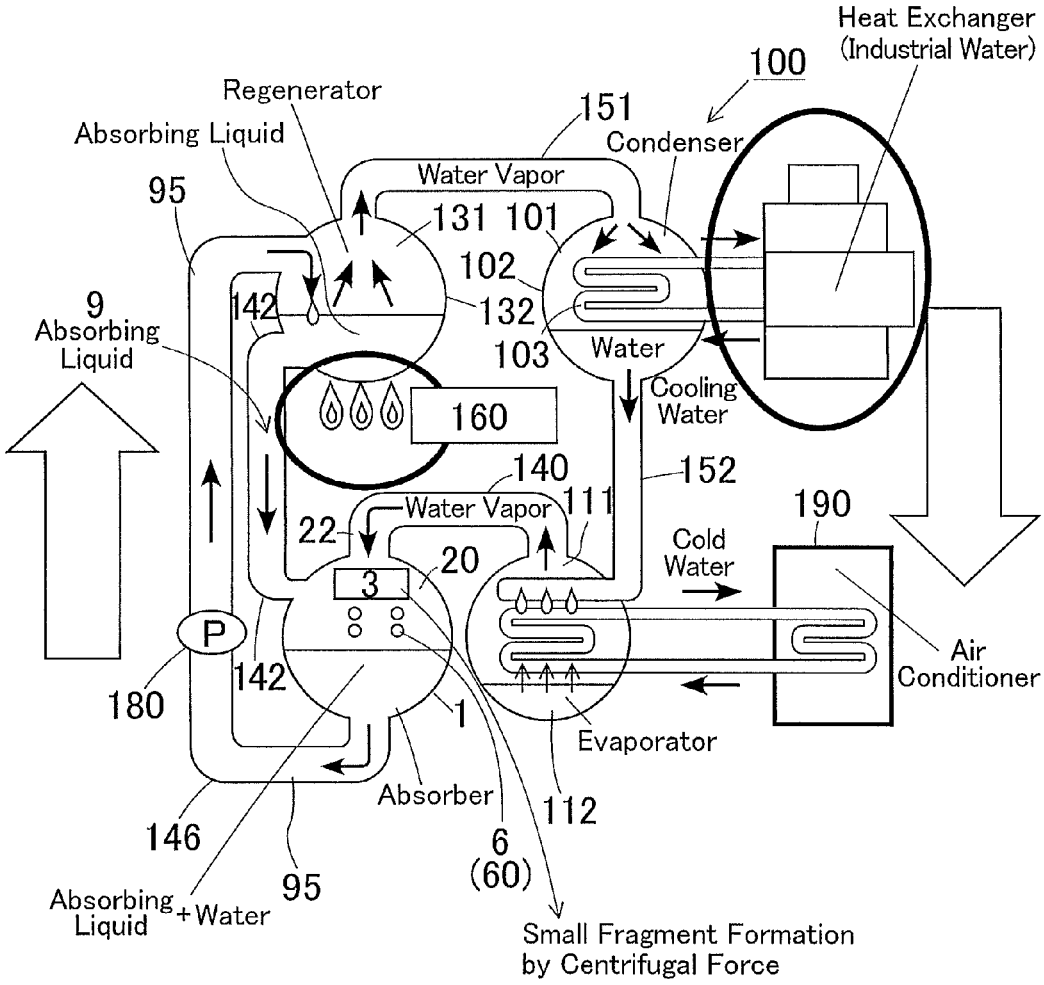
FIG. 5 is a system diagram showing an absorption heat pump device according to a fifth embodiment.

FIG. 5 is a schematic diagram showing a fifth embodiment. The present embodiment has basically similar constitution and effects to those of the first embodiment, and the present embodiment is applied to an absorption heat pump device (an absorption refrigerator) 100. This device 100 comprises a condenser 102 having a condensation chamber 101, an evaporator 112 (a water vapor supply source, a diluent supply source) having an evaporation chamber 111 which is kept under high vacuum, an absorber 1 having a dilution chamber 20, and a regenerator 132 (an absorbing liquid supply source, a viscous substance supply source) having a regeneration chamber 131. The absorber 1 is constituted by the absorber according to each of the abovementioned embodiments shown in FIGS. 1 to 4. As mentioned before, this absorber 1 employs a system in which a highly viscous absorbing liquid is divided into fine particles by centrifugal force based on rotation of a rotor and contacted with water vapor.

Moreover, an absorbing liquid supply portion 142 (a viscous substance supply portion) is provided so as to connect the regeneration chamber 131 of the regenerator 132 and the dilution chamber 20 of the absorber 1. A water vapor supply portion 140 (a diluent supply portion) is provided so as to connect the evaporation chamber 111 of the evaporator 112 and the dilution chamber 20 of the absorber 1.

As shown in FIG. 5, the condenser 102 has a cooling pipe 103 to flow a refrigerant. In the condenser 102, water vapor supplied from the regenerator 132 through a passage 151 is condensed by being cooled by the cooling pipe 103, thereby forming liquid phase water and obtaining latent heat of condensation. The liquid phase water formed in the condenser 102 transfers to the evaporator 112 through a passage 152. In the evaporator 112, the liquid phase water drops down from holes of the passage 152 into the evaporation chamber 111. The dropped liquid phase water becomes water vapor in the evaporation chamber 111 in high vacuum. In the evaporation chamber 112, the liquid phase water formed in the condenser 102 is thus evaporated to form water vapor and obtain latent heat of evaporation (endothermic reaction). The latent heat of evaporation is used as a cooling function of an air conditioner 190. The water vapor evaporated in the evaporator 112 is supplied via a water vapor supply portion 140 and a water vapor supply port 22 to the dilution chamber 20 of the absorber 1.

In the absorber 1, the highly viscous absorbing liquid 9 serving as the viscous substance is supplied from the absorbing liquid supply portion 142 into the dilution chamber 20 of the absorber 1 by gravity. The highly viscous absorbing liquid 9 supplied to the dilution chamber 20 is finely fragmented by centrifugal force based on high-speed rotation of the rotor 3 and becomes a small fragment group comprising a number of small fragments, thereby exponentially increasing in absorption area. As a result, the small fragments absorb water vapor and get diluted in the dilution chamber 20 to become the diluted absorbing liquid 95.

The diluted absorbing liquid 95 formed in the dilution chamber 20 of the absorber 1 is transferred by a pump 180 (an absorbing liquid transfer source) in a passage 146 and returned to the regeneration chamber 131 of the regenerator 132. The diluted absorbing liquid 95 returned to the regeneration chamber 131 has decreased in viscosity. The diluted absorbing liquid 95 thus returned to the regeneration chamber 131 is heated by a heater 160 such as a combustion burner and an electric heater to evaporate water vapor and be concentrated. The water vapor is supplied to the condensation chamber 101 via the passage 151 and forms condensed water. The diluted absorbing liquid 95 is thus concentrated in the regeneration chamber 131 and becomes highly concentrated, highly viscous absorbing liquid 9 again. The highly viscous absorbing liquid 9 is supplied from the regeneration chamber 131 (the viscous substance supply source) through the absorbing liquid supply portion 142 to the dilution chamber 20 of the absorber 1 again by gravity. Then, the highly viscous absorbing liquid 9 is finely fragmented by centrifugal force based on rotation of the rotor 3 to become a small fragment group (a fine particle group) comprising a number of small fragments (fine particles). Moreover, while attached to the heat transfer pipe group 6, the small fragments are contacted with water vapor and diluted with water vapor while cooled by the heat transfer pipe group 6.

Herein, the absorbing liquid 9 is exemplified by lithium bromide and lithium iodide. Solutions of a high concentration of these have high viscosity. Thus, in the absorption heat pump device, heat of condensation is obtained in the condenser 102 and a heating function can be obtained. On the other hand, endothermic reaction is obtained due to latent heat of evaporation in the evaporator 112 and a cooling function can be obtained.

The absorber 1 in the abovementioned absorption heat pump device 1 is constituted by the absorber 1 according to each of the abovementioned embodiments. Therefore, highly concentrated absorbing liquid 9 is dropped down from a drip port of the absorbing liquid supply portion of the absorber 1 into the dilution chamber 20 of the absorber 1. The absorbing liquid 9 thus dropped absorbs water vapor supplied from the water vapor supply port 22 to the dilution chamber 20 and gets diluted to become lowly concentrated, diluted absorbing liquid 95. In this case, as described in the above embodiments, the highly concentrated absorbing liquid 9 in a finely fragmented state is contacted with water vapor. Therefore, even though the absorbing liquid 9 is a highly viscous substance, the absorbing liquid 9 in the form of fine particles exponentially increases in its own exposure area and accordingly exponentially increases in area of contact with water vapor and can absorb water vapor efficiently.

According to the present embodiment, it is preferable that a common motor is used as a motor for the pump 180 (the absorbing liquid transfer source) which transfers the diluted absorbing liquid 95 from the absorber 1 to the regenerator 132, and as the driving source 39 constituted by a motor for rotating the rotor 3 which exerts centrifugal force for fine fragmentation (fine particle formation) used in the embodiments shown in FIGS. 1 to 4. This is advantageous in reducing the number of component parts because of the use of a common motor. When the absorption heat pump device is operated, the pump 180 is driven and at the same time the absorber 1 is also required to be actuated, so the use of a common motor is convenient. Moreover, when operation of the absorption heat pump device is stopped, operation of the pump 180 is stopped and at the same time actuation of the absorber 1 is also required to be stopped, the use of a common motor is convenient.

Others

According to the above first embodiment, the heat transfer pipes 4 which serve a function to cool the absorbing liquid on the heat transfer pipes 4 are employed as the member for attachment in order to enhance water vapor absorbability. However, the member for attachment is not limited to this and just hollow pipes, bars, flat plates, or a mesh sheet can be arranged in the dilution chamber 20 as the member for attachment. In this case, the highly viscous absorbing liquid 9 is attached to the member for attachment comprising hollow pipes, bars, flat plates, a mesh sheet or the like. In this case, it is preferable that a cooling portion for cooling an inside of the dilution chamber 20 is provided in the dilution chamber 20 to cool the absorbing liquid. The cooling portion can employ a structure for flowing a liquid coolant such as cooling water or a cooling head of a refrigeration cycle.

Although the second rotor 32 is provided in addition to the first rotor 31 according to the abovementioned first embodiment, in some cases the second rotor 32 can be omitted. Moreover, although the first fixed body 41 and the second fixed body 42 are provided according to the abovementioned first embodiment, in some cases the first fixed body 41 and the second fixed body 42 can be omitted. Even in this case, since water vapor is stirred by the vanes 43, 44, frequency of contact between water vapor and the absorbing liquid can be increased.

The present invention should not be limited to the embodiments mentioned above and shown in the drawings, and appropriate modifications of the present invention may be made without departing from the gist of the present invention. The following technical idea can also be grasped from the foregoing description.

APPENDIX 1

A heat exchanger comprising a vessel having a dilution chamber, a viscous substance supply portion provided in the vessel and supplying a viscous substance to the dilution chamber, a rotor rotatably provided in the dilution chamber of the vessel and finely fragmenting the viscous substance supplied to the dilution chamber to form a small fragment group comprising a number of small fragments of the viscous substance, a diluent supply portion provided in the vessel and supplying a diluent to the dilution chamber so that the small fragment group formed by rotation of the rotor and the diluent are contacted with each other, and a member for attachment provided in the dilution chamber of the vessel, having a passage through which a heat exchange medium flows, and to get attached by the viscous substance in the form of fine particles and cause the attached viscous substance to exchange heat with the heat exchange medium. In this case, the viscous substance attached to the member for attachment is contacted with the diluent and get diluted while exchanging heat with the heat exchange medium. Heat exchange of the heat exchanger can be carried out in the form of cooling the viscous substance or heating the viscous substance.

INDUSTRIAL POSSIBILITY

The present invention can be applied to a viscous substance diluting device for dividing a viscous substance having a high viscosity into small fragments and then diluting this fragmented viscous substance with a diluent. For example, the present invention can be applied to an absorber in an absorption heat pump device.

The invention claimed is:

1. A device for diluting a viscous substance, comprising:

a vessel having a dilution chamber;

a viscous substance supply portion provided in the vessel for supplying the viscous substance to the dilution chamber;

a first rotor and a second rotor rotatably provided in the dilution chamber of the vessel for finely fragmenting the viscous substance supplied to the dilution chamber by rotation to form a small fragment group comprising a number of small fragments of the viscous substance;

a diluent supply portion provided in the vessel for supplying a diluent to the small fragment group formed by rotation of the rotor first and second rotors in the dilution chamber;

a member for attachment provided in the dilution chamber of the vessel and configured to be attached by the small fragments of the viscous substance such that the attached small fragments of the viscous substance are diluted with the diluent thereby decreasing in viscosity of the viscous substance; and a reservoir chamber for reserving the viscous substance diluted by the contact between the small fragment group and the diluent, wherein the second rotor has a conical shape with an inner diameter that increases in a direction from a lower portion to an upper portion of the device and an outer diameter that increases in the direction from the lower portion to the upper portion of the device, the second rotor defining a re-dilution rotary portion for dividing the viscous substance reserved in the reservoir chamber into small fragments again by rotation and bringing the small fragments and the diluent in contact with each other again so as to further dilute the viscous substance, and wherein a suction portion is provided for sucking up the diluted viscous substance reserved in the reservoir chamber when the second rotor rotates, in a manner to penetrate the lower portion of the second rotor in a thickness direction thereof.

2. The device for diluting a viscous substance according to claim 1, wherein the member for attachment has a cooling function to cool the viscous substance attached to the member for attachment.

3. The device for diluting a viscous substance according to claim 1, wherein the member for attachment comprises a heat transfer pipe group comprising a plurality of heat transfer pipes having a passage through which a refrigerant flows.

4. The device for diluting a viscous substance according to claim 1, wherein the diluent supply portion supplies the diluent to an outer side of the small fragment group generated in the dilution chamber, thereby forming diluent flow and suppressing excessive scattering of the small fragment group of the viscous substance in the dilution chamber by the diluent flow.

5. The device for diluting a viscous substance according to claim 1, wherein a diluent stirring portion for increasing probability of contact between the small fragments and the diluent by stirring the diluent in the dilution chamber is provided in the dilution chamber.

6. The device for diluting a viscous substance according to claim 1, used in an absorber in an absorption heat pump device.

* * * * *